US005626485A

United States Patent [19]

Clyatt, III et al.

[11] Patent Number: 5,626,485

[45] Date of Patent: May 6, 1997

[54] SWITCHING CONNECTOR APPARATUS

[75] Inventors: Clarence L. Clyatt, III, Goodyear; James E. Thompson, Phoenix, both of Ariz.

[73] Assignee: ITT Industries, New York, N.Y.

[21] Appl. No.: 319,061

[22] Filed: Oct. 6, 1994

[51] Int. Cl.[6] ..... H01R 29/00

[52] U.S. Cl. ..... 439/188; 200/51.09

[58] Field of Search ..... 439/188, 607, 439/608, 95; 200/51.09, 51.11, 51.12, 51.13

[56] References Cited

U.S. PATENT DOCUMENTS

| | | | |
|---|---|---|---|
| 3,083,274 | 3/1963 | Sparkes | 200/51.09 |
| 3,599,167 | 8/1971 | Adrian et al. | 439/188 X |
| 3,843,853 | 10/1974 | Panek et al. | 200/51.09 |
| 4,264,115 | 4/1981 | Chow | 439/188 X |
| 5,147,988 | 9/1992 | Appleton | 439/188 X |

*Primary Examiner*—Jes F. Pascua
*Attorney, Agent, or Firm*—Freilich Hornbaker Rosen

[57] ABSTRACT

A first connector (12, FIG. 2) is constructed so when it is unmated from a second connector (14), front contact devices (32) of the first connector are switched from connections to conductors (16) leading to circuit component (70) to connection to a ground plane (110). The first connector comprises a front insert assembly (22) that includes a plurality of front contact devices (32), and a rear insert assembly (50) that includes a plurality of rear contacts (62). When the second connector fully mates with the first one (FIG. 3), the second connector pushes the front insert assembly to a rearward position (22B), against the force of a spring (40), to cause the front contact devices to mate with the rear contacts. When the second connector unmates from the first one, the spring moves the front insert assembly to the forward position. During forward movement, the front contact devices engage the ground plane (110), to thereby ground the front contact devices when they are not mated to the rear contacts.

9 Claims, 2 Drawing Sheets

Rr
152
158
160Y
156
32Y
62Y
50X
22X
80Y
155
150
160
154
162
84X
80X
16
12
10
14
18
110
122
A
36
132
124
38
126
32
130
34
Fr
120
B

SWITCHING CONNECTOR APPARATUS

BACKGROUND OF THE INVENTION:

The contacts of a connector are commonly connected through wires to circuit components. There are applications where it is desirable to isolate the circuit components from the contacts when the connector is unmated from a second connector, or at least protect the circuit components from stray currents that the contacts might be exposed to when the connectors are unmated. One application is for a connector on a rocket, which unmates from a second connector at the launch facility when the rocket rises. When the rocket moves rapidly through the atmosphere, stray currents may be applied to the contacts, which could damage or interfere with components connected through wire conductors to the contacts. One solution has been to provide a cover that moves over the exposed end of the rocket connector. However, the contacts still can pick up some interfering noise. It would be desirable if a switch were provided for each contact, and if such switches were opened whenever the connectors were unmated. However, where a connector includes a large number of contacts, such switches would add considerable volume, weight, and complexity. A simple and compact switching arrangement that decoupled connector contacts from circuit components when the connector was riot mated to another one, while shielding the components from EMI (electromagnetic interference) that might come from the area occupied by the connector, would be of value.

SUMMARY OF THE INVENTION

In accordance with one embodiment of the present invention, a switching connector apparatus is provided which disconnects each of the plurality of front contact devices of a first connector from a corresponding plurality of conductors, when the first connector is unmated from a second one. The first connector includes a front insert assembly that is mounted in a first shell and that carries a plurality of front contact devices. The first connector also includes a rear insert assembly that is mounted in the first shell and that includes a plurality of rear contacts. The front insert assembly is movable within the shell to a rearward position wherein the front contact devices engage the rear contacts, and to a forward position wherein the front contact devices are disengaged from the rear contacts. A spring urges the front insert assembly towards its forward position, but the front insert assembly is moved rearwardly by a second connector when it fully mates with the first one.

The first connector includes a ground plane having contact-engaging parts. The ground plane is positioned to engage conductive parts of the front contact devices when the front insert assembly is in its forward position, and to disengage therefrom when the front insert assembly moves to its rearward position.

The novel features of the invention are set forth with particularity in the appended claims. The invention will be best understood from the following description when read in conjunction with the accompanying drawings.

DESCRIPTION OF THE PREFERRED EMBODIMENTS

Figures 1, 4, 5, 6, 7:
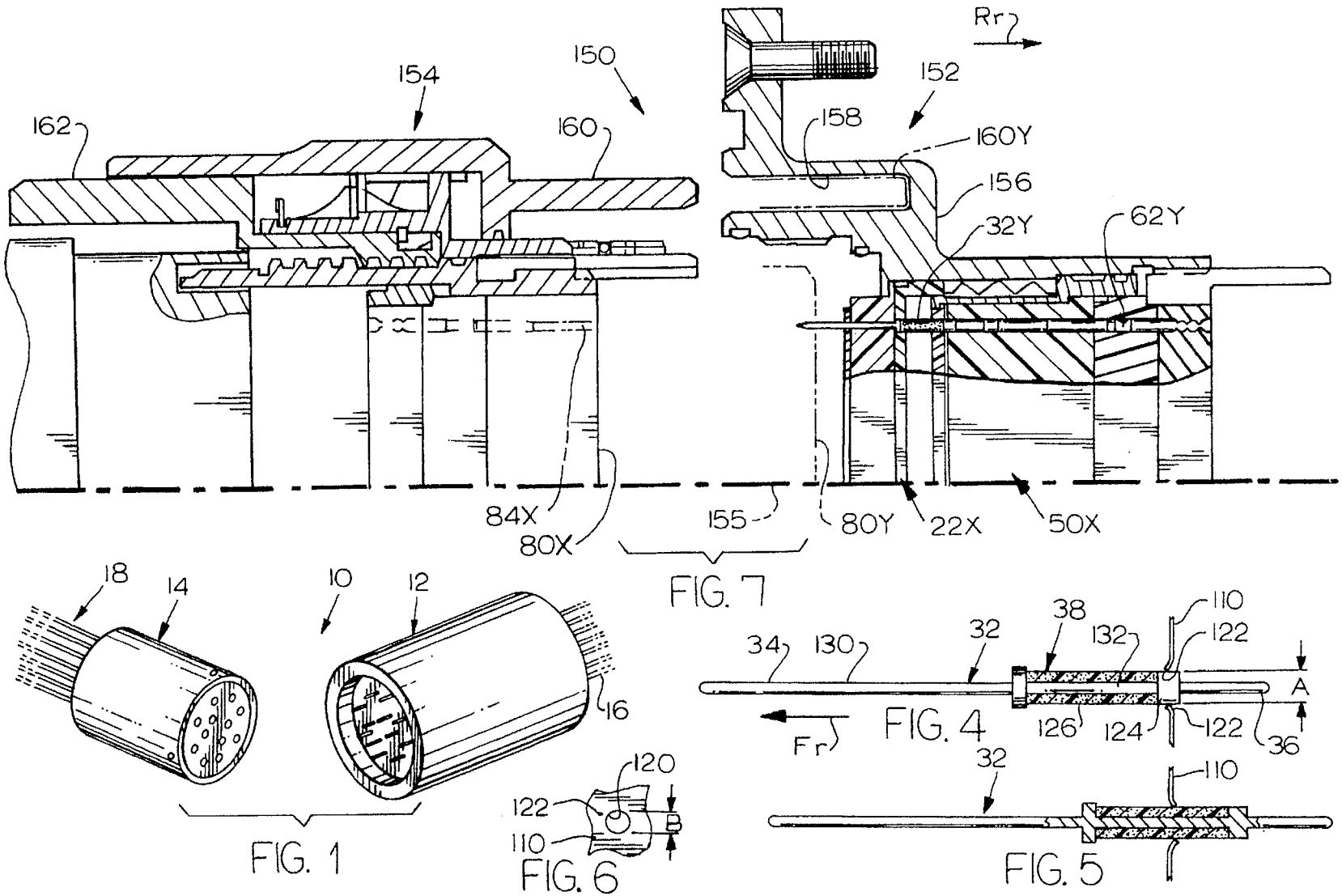
FIG. 1 is an isometric view of a connector apparatus constructed in accordance with the present invention, showing the first and second connectors unmated.
FIG. 4 is a sectional view of a front contact device of the first connector of FIG. 2, in the forward position of the front insert assembly.
FIG. 5 is a view similar to that: of FIG. 4, but in the rearward position of the front insert assembly.
FIG. 6 is a partial front elevation view of the ground plane of FIG. 4 prior to the insertion of a front contact device therein.
FIG. 7 is a sectional side view of a connector apparatus constructed in accordance with a second embodiment of the invention, showing first and second connectors unmated, and showing only those portions of the connectors that lie on one side of the connector axes.

FIG. 1 illustrates a connector apparatus 10 which includes a first or receptacle connector 12 and a second or plug connector 14. Groups of wire conductors 16, 18 trail from each connector, and corresponding conductors of the two groups are connected when the two connectors are mated. The conductors are shown as part of insulated wires, but can be traces on a circuit board.

Figure 2:
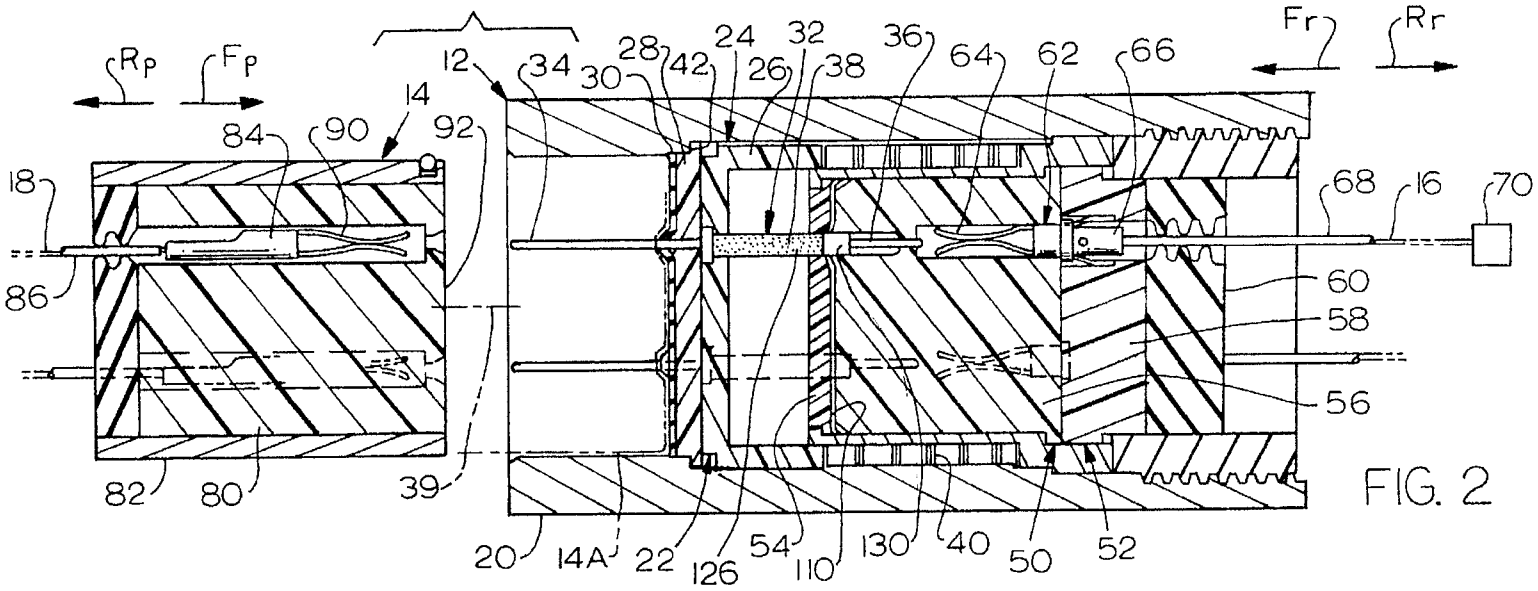
FIG. 2 is a sectional side view of the connector apparatus of FIG. 1, with the connectors unmated.

As shown in FIG. 2, the first connector 12 includes a first housing or shell 20 and a front insert assembly 22 that is mounted in the shell. The first insert assembly includes an insulator 24 formed by a pair of insulator parts 26, 28 and a seal 30. The assembly also includes a plurality of front contact devices 32 that are mounted in the insulator. Each front contact device has front and rear pin contact ends 34, 36 and has a middle 38 between them. The front insert assembly 2; is slidably disposed within the directions with respect to the first or receptacle connector) along an axis 39. A spring 40 urges the front insert assembly in the forward direction, until the assembly abuts a shell shoulder 42. The particular spring illustrated is a wave spring which is similar to a stack of wave springs except it is formed by a continuous band extending in a helix and bent to form waves therein.

The first connector includes a rear insert assembly 50 that is mounted in the shell rearward of the front insert assembly. The rear insert assembly includes an insulator 52 having several insulator parts 54, 56, 58, and 60. The rear insert assembly also includes a plurality of rear contacts 62 that have socket front ends 64 and that have rear ends 66 that are connected to the conductors 16 of wires 68, that lead to circuit components 70. The circuit components can be integrated circuits, capacitors, resistors, etc. A connector may have a large number of contacts, with most of them generally carrying signals (such as pulses or modulated analog signals, representing data), although a limited number may carry power current (DC or substantially unmodulated AC).

The second connector 14 includes a second insert assembly 80 lying in a second shell 82. The second insert assembly includes a plurality of second contacts 84 each connected to a conductor 18 of an insulated wire 86. The connectors are initially mated when the second connector moves to the position 14A at which socket contact ends 90 of the second contacts mate with the pin front ends 34 of the front contact devices 32. After the second connector reaches the initial mating position 14A, it is moved further in the direction Fp (which is the same as Rr) while a push surface 92 of the second connector pushes the front insert assembly in the direction Rr. Finally, the connectors reach their fully mated positions shown at 14B and 12B in FIG. 3.

Figure 3:
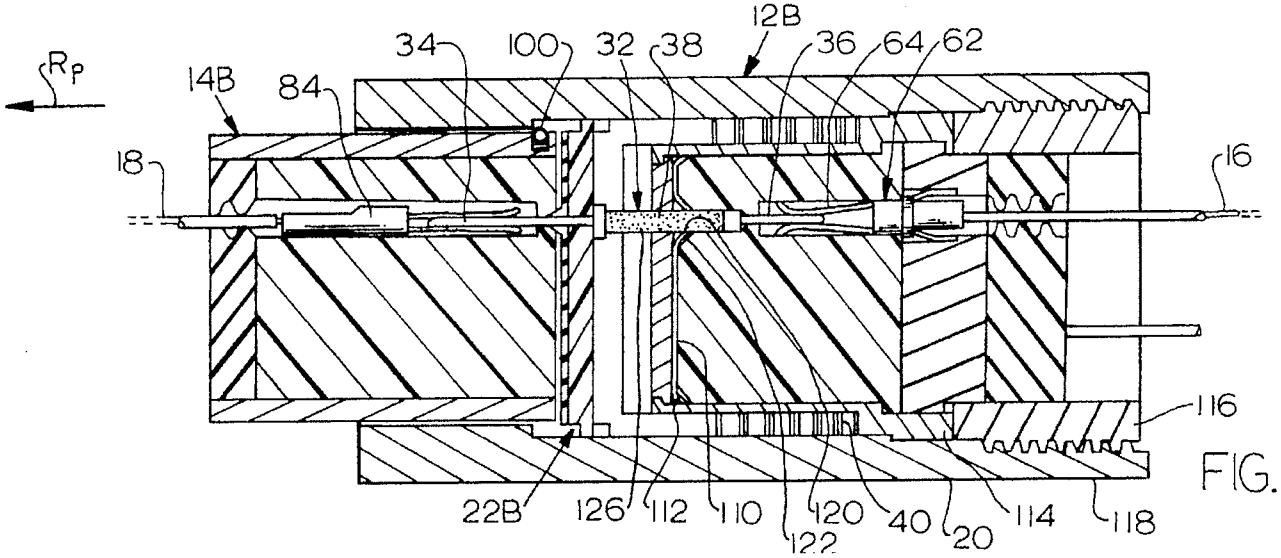
FIG. 3 is a view similar to that of FIG. 2, showing the connectors fully mated.

In the fully mated positions of FIG. 3, the rear end 36 of the front connector device 32 has mated with the rear connectors 62. This is because the front insert assembly has moved to a rearward position 22B against the biasing of the spring 40. The front connector devices 32 then serve to connect the second contacts 84 of the second connector at 14B to the rear contacts 62 of the first connector at 12B, and therefore to the conductors 16 that extend to circuit components. FIG. 3 shows the second connector having a latch 100 in the form of radially outwardly-biased balls, which hold the connectors in the fully mated positions. The latch enables the second connector to be withdrawn in the rearward direction Rp when a large force is applied to it in that direction. When the second connector at 14B is unmated by movement in the direction Rp, the front insert assembly at 22B moves forwardly under the force of the spring 40 to the unmated position 22 shown in FIG. 2. In the unmated position, the rear ends 36 of the front contact devices are out of engagement with the rear contacts 62, to thereby isolate the conductors 16 from the front contact devices and from any currents that might be applied from the exposed front ends 34 of the front contact devices.

FIGS. 2 and 3 show a ground plane 110 which is mounted in a fixed position in the first shell 20, preferably by mounting the ground plane in the rear insulator 52, as by mounting it facewise between the insulator parts 54, 56 thereof. The ground plane includes a peripheral portion 112 that is electrically connected to the first shell 20, through an intermediate shell part 114 that contacts a retainer shell part 116 and an outer shell part 118. The ground plane has a plurality of holes 120 that each receives one of the front contact devices 32, with the walls 122 of the holes forming contact-engaging parts that engage the periphery of the middle 38 of the front contact devices.

Each front contact device 3 includes a front contact or conductive main part 130 and a dielectric part 126 that lies at the middle 38 of the device. In the rearward position of FIG. 3, the walls 122 of the ground plane holes engage the dielectric parts 126 and thereby avoid grounding the conductive main parts of the front contact devices, to thereby allow electrical signals to pass between the conductors 16, 18. In the forward position of FIG. 2, the front contact devices 32 have moved forward to a position at which the walls of the ground plane holes engage the conductive main parts 130, to thereby ground the front contact devices.

There is considerable benefit in grounding the front contact devices when they are not connected to the rear contacts. By grounding the front contact devices, any current applied to them, as through ionized gas generated when the first connector is mounted on a rocket that moves rapidly through the atmosphere, or from lightening or other causes, is dissipated to ground potential. This prevents such currents from inducing noise in corresponding rear contacts or from creating sparks that could pass such current to the rear contacts. The ground plane 110 also electrically seals the region forward of the rear contacts 62 to prevent electromagnetic interference from passing to the rear contacts through the open front end of the shell.

FIG. 4 shows the construction of one of the front contact devices 32. The device includes the main part 130 that has a collar 124 and a thin rod part 132 extending forward in direction Fr, from the collar. A quantity of solidified polymer at 126 surrounds the rod part and forms the dielectric covering part. The ground plane 110 is preferably formed of a sheet of flexible polymer imbedded with particles of conductive material such as silver particles, so the ground plane is conductive and yet the walls 122 of its holes can be easily flexed. That is, the walls of the holes can be readily deflected forward and backward. As shown in FIG. 6, applicant forms the holes 120 in the ground plane so they have a diameter B that is slightly less than the diameter A of the collar conductive part 124 to form an interference fit. This assures good contact of the ground plane hole walls with the conductive part of the front contact device. As the front contact device moves forward and rearward, the hole walls 122 "oil can", that is, they first bend partially forward, and then bend partially rearward.

FIG. 7 illustrates a connector apparatus 150 that includes first and second connectors 152, 154 that applicant has constructed and successfully tested. The figure shows only a portion on one side of an axis 155. The first connector 152 includes a receptacle shell 156 and front and rear contact assemblies 22X, 50X similar to those of FIGS. 2 and 3. The receptacle shell 156 has a groove 158 that is designed to receive a flange 160 of the second connector. When the second connector is initially mated to the first one, so the flange is at the position 160Y, a second insert assembly 80X of the second connector is moved to the position 80Y, wherein its second contacts 84X initially engage front ends of the front contact devices 32Y of the first connector. At that position, the connectors are latched together and a coupling sleeve 162 is turned to advance the second connector assembly at 80Y in the direction Rr. As the second assembly advances, the second contacts fully mate with the front contact devices 32Y. Further turning of sleeve 162 pushes the front contact devices 32Y rearwardly until they engage rear contacts 62Y, in the manner shown in FIGS. 2 and 3 for the connectors thereof.

Although most of the front contact devices are likely to have a dielectric around a portion of its main conductive part, a connector can include one or more front contact devices that are intended to be always grounded. Such contact devices may be devoid of any dielectric covering. A connector also may include contacts intended to be never grounded, as well as optical fiber contacts.

Thus, the invention provides a connector apparatus which includes a first connector with front contact devices at its front end, which do not electrically connect to conductors extending from the rear of the first connector until a second connector is fully mated with the first one. Similarly, when the second connector unmates from the first one, the front contact devices are disconnected from the conductors. This is accomplished by providing rear contacts on a rear contact assembly, that are positioned so when a front insert assembly, on which the front contact devices are mounted, moves rearward and then forward, the front contact devices mate and then unmate from the rear contacts. A ground plane is mounted in the first connector, preferably in the rear insert assembly, and has walls that engage a conductive part of the front contact devices only when the front insert assembly moves forward.

The novel features of the invention are set forth with particularity in the appended claims. The invention will be best understood from the following description when read in conjunction with the accompanying drawings.

What is claimed is:

1. Connector apparatus which comprises a first connector that includes a first shell and a front insert assembly that is mounted in said first shell, with said front, insert assembly including a plurality of front contact devices that each includes an electrically conductive parts, characterized by:

said first connector includes a rear insert assembly that is mounted in said first shell and that includes a plurality of rear contacts;

said front insert assembly is movable within said shell between forward and rearward positions wherein said front contact devices lie respectively unmated and mated to said rear contacts;

said first connector includes an electrically grounded member having contact engaging parts positioned to engage and not engage said conductive parts of said front contact devices when said front insert assembly lies in said forward and rearward positions, respectively.

2. The connector apparatus described in claim 1 wherein:

said first connector includes a spring which urges said first connector toward said forward position; and including a second connector which is matable to said first connector and which has a second insert assembly with a plurality of second contacts that are positioned to mate with said front contact devices when said first and second connectors mate, said second connector having a push surface which is positioned to abut said front contact assembly and move it against the urging of said spring to said rearward position.

3. The connector assembly described in claim 1 wherein:

said grounded member lies in said rear insert assembly and each of said plurality of front contact devices includes a conductive part with a conductive surface that lies in said rear insert assembly and that is positioned to engage said grounded member when said front insert assembly lies in said forward position;

each of said plurality of front contact devices has a dielectric part lying forward of said conductive part and positioned to engage said grounded member when said front insert assembly lies in said rearward position.

4. The connector assembly described in claim 1 wherein:

each of said plurality of front contact devices includes an electrically conductive main part with a cylindrical collar and a narrower rod part lying forward of said collar, and a quantity of solidified dielectric polymer with a substantially cylindrical outside surface, lying around said rod part;

said grounded member comprises a sheet of flexible polymer with electrically conductive particles therein, said sheet being substantially fixed in position in said shell and having a plurality of holes that each receives one of said front insert assemblies, with each hole having a smaller diameter than said cylindrical collar, and with each of said holes positioned to engage said collar when the first insert assembly is in its forward position and to engage said outside surface of said quantity of dielectric polymer when the first insert assembly is in its rearward position.

5. A switching connector assembly comprising:

a shell;

a rear insert assembly which includes a rear insulator lying in said shell and a plurality of rear contacts mounted in said rear insulator, said rear contacts having matable front ends;

a front insert assembly which includes a front insulator lying in said shell and a plurality of front contact devices mounted in said front insulator at positions forward of and substantially aligned with said rear contacts, said front contact devices having matable front and rear ends;

said front insert assembly being movable in forward and rearward directions within said shell, with said front contact devices being positioned so their matable rear ends mate with and unmate from said front ends of said rear contacts when said front insert assembly moves rearwardly and forwardly, respectively, said front contact devices each have an electrically conductive main part; and including an electrically grounded member which lies in said shell and which has parts positioned to lie out of engagement with said front contact main parts when said insert assembly is in a rearward position, and to engage each of said plurality of front contacts when said front insert assembly moves forward to a forward position.

6. The connector assembly described in claim 5 wherein:

grounded member lies in said rear insulator and each of said plurality of front contact devices has a conductive part that lies in said rear insert assembly and that is positioned to engage grounded member when said front insert assembly lies in said forward position;

each of said plurality of front contact devices has a dielectric part lying forward of said conductive part and positioned to engage grounded member when said front insert assembly lies in said rearward position.

7. The connector assembly described in claim 5 including:

a mating second connector which includes a second insert assembly comprising a second insulator and a plurality of second contacts mounted in said second insulator;

said second insert assembly is constructed to mate with said front insert assembly, with said second contacts mating with said front ends of said front contact devices, and said second insert assembly is constructed to push said front insert assembly rearwardly until said rear ends of said front contact devices mate with said front ends of said rear contacts while maintaining said second contacts mated with said front ends of said front contacts.

8. A method for connecting, to a corresponding different one of a plurality of conductors, each of a plurality of front contact devices that are mounted on a front insert assembly that lies in a first housing of a first connector, when a second connector mates to said first connector and each of a plurality of second contacts of said second connector mate to front ends of each of said plurality of front contact devices, but safeguarding each of said conductors from any current applied to said front contact devices when said second connector unmates from said first connector and said second contacts unmate from said front contact devices, characterized by:

establishing in said first housing, a rear insert assembly that includes a plurality of rear contacts, and connecting each of said plurality of conductors to a corresponding one of said plurality of rear contacts;

moving said front insert assembly and said front contact devices thereon rearwardly to a rear position and mating said front contact devices to said rear contacts substantially when fully mating said second connector to said first connector, and moving said front insert assembly and said front contact devices thereon forwardly to a forward position and unmating said front contact devices from said rear contacts substantially when fully unmating said second connector from said first connector;

establishing a grounded member in said first housing with contact-engaging parts that are each positioned to electrically engage and thereby electrically connect to one of said front contact devices when said front insert assembly and said front devices thereon move forwardly to said forward position, and to electrically disengage from one of said front contact devices when said front insert assembly and said front contact devices move rearwardly to said rearward position.

9. The method described in claim 8 wherein:

each of said front contact devices includes an electrically conductive main part with a ground-engaging part, and each of said front contact devices includes a covering of dielectric material lying forward of said ground-engaging part;

said step of establishing a grounded member includes positioning contact-engaging parts thereof to engage said ground-engaging parts and said coverings of said front contact devices, when said front insert assembly is respectively in said forward and rearward positions.

* * * * *